US007228849B1

(12) United States Patent
Preston

(10) Patent No.: US 7,228,849 B1
(45) Date of Patent: Jun. 12, 2007

(54) CONICAL CONCAVE CAP PRESSURE RELIEF VALVE

(75) Inventor: Grover W. Preston, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/540,463

(22) Filed: Sep. 29, 2006

(51) Int. Cl.
*F02M 37/00* (2006.01)
*F02M 37/08* (2006.01)

(52) U.S. Cl. ..... 123/511; 123/457; 123/459

(58) Field of Classification Search ..... 123/511, 123/516, 518, 520, 198 D, 457, 459, 461, 123/463; 137/43, 202, 587
See application file for complete search history.

(56) References Cited

U.S. PATENT DOCUMENTS 4,579,135 A * 4/1986 Sakata et al. ..... 137/39
4,625,695 A * 12/1986 Tuckey ..... 123/463
4,633,901 A * 1/1987 Brandt et al. ..... 137/510
4,655,238 A * 4/1987 Szlaga ..... 137/43
5,623,910 A * 4/1997 Riggle ..... 123/510
5,640,989 A * 6/1997 Nemoto et al. ..... 137/39
5,762,101 A 6/1998 Burke et al.
6,308,735 B1 * 10/2001 Foltz ..... 137/587
6,382,183 B1 * 5/2002 Preston et al. ..... 123/457
6,520,163 B2 * 2/2003 Yoshioka et al. ..... 123/510

FOREIGN PATENT DOCUMENTS

GB 947071 1/1964

* cited by examiner

*Primary Examiner*—Mahmoud Gimie
(74) *Attorney, Agent, or Firm*—Paul L. Marshall

(57) ABSTRACT

A pressure relief valve useful in vehicle fuel delivery systems includes a spring biased, concave conical flow directing surface and a spherical valve seat.

22 Claims, 2 Drawing Sheets

CONICAL CONCAVE CAP PRESSURE RELIEF VALVE

TECHNICAL FIELD

The present invention generally relates to pressure relief valves useful in vehicle fuel delivery systems.

BACKGROUND OF THE INVENTION

Various types of pressure relief valves are known for controlling fuel delivery pressure in so-called single-line forward fuel injection systems. Diaphragm-type pressure regulating valves have been used but are large and expensive. Smaller and less expensive ball-on-seat valves have also been used but are not sufficiently sensitive to changes in the fuel consumption rate of the motor for application as a pressure regulating valve in single line forward motor vehicle injection systems.

A prior art pressure regulating valve is seen in U.S. Pat. No. 5,762,101 issued to General Motors Corporation, the entire disclosure of which is incorporated herein by reference. The valve of the '101 patent includes a valve element having a surface which is spring biased to close against a circular valve seat. An annular orifice is created when the flow overcomes the bias of the spring and moves the valve element away from the valve seat. The flow directing surface of the valve element redirects fluid flow upstream of the orifice. The fluid is redirected at an included angle less than 180° to induce on the valve element a force reaction, which cooperates with a fluid pressure force reaction on the valve element to improve sensitivity of the valve element to changes in fluid pressure upstream of the annular flow orifice, attributable to changes in the rate of fuel consumption by the motor. A skirt of the flow directing surface downstream of the annular flow orifice directs fluid flow substantially parallel to the direction of movement of the valve element to minimize the sensitivity of the valve element to a velocity-induced pressure gradient across the valve element. While the valve of the '101 patent improves the sensitivity response to fuel consumption at the motor, a reliable seal between the concave hemispherical valve element and truncated valve seat is sometimes difficult to achieve. It would therefore be desirable to have an improved pressure relief valve which is sensitive to fuel consumption at the motor and reliably maintains a seal in the closed position of the valve even in the event of non-axial movement of the valve element, for example.

SUMMARY OF THE INVENTION

The present invention provides a pressure relief valve having a valve body with a longitudinal bore opening providing a flow channel extending between first and second ends of the valve body. A valve element is placed in axially movable relationship in the opening of the valve body and is spring biased against a valve seat to create a fluid-tight seal, thereby preventing passage of fuel through the valve when in this closed position. When the fluid force becomes greater than the biasing force of the spring, the valve element is pushed away from the valve seat, thereby creating an opening between the valve element and the valve seat wherethrough fuel may pass.

The valve element has a substantially conically shaped surface while the valve seat includes a substantially hemispherical surface. When the valve is in its closed position, the conical surface of the valve element sits against the hemispherical surface of the valve seat, thereby forming a fluid-tight seal therebetween. Should the valve element move in an axially off-set manner when in the closed position, the fluid-tight seal is maintained due to the conical-hemispherical interface which is effective to maintain a seal even if the valve element unintentionally tilts away from the central axis of the valve body. As such, the valve of the present invention is more reliable than prior valves which fail to maintain a seal should there be even small errors in the manufacturing tolerances and intended movement of the valve.

The conical shape of the valve element is a flow directing surface which redirects the fluid flow upstream of the valve element through an angle greater than about 90° which improves the sensitivity of the valve to changes in fluid pressure occurring upstream of the flow orifice. These fluid pressure changes are attributable to changes in the rate of fuel consumption by the engine.

BRIEF DESCRIPTION OF THE DRAWINGS

The present invention will now be described, by way of example, with reference to the accompanying drawings, in which.

DETAILED DESCRIPTION

Figure 1:
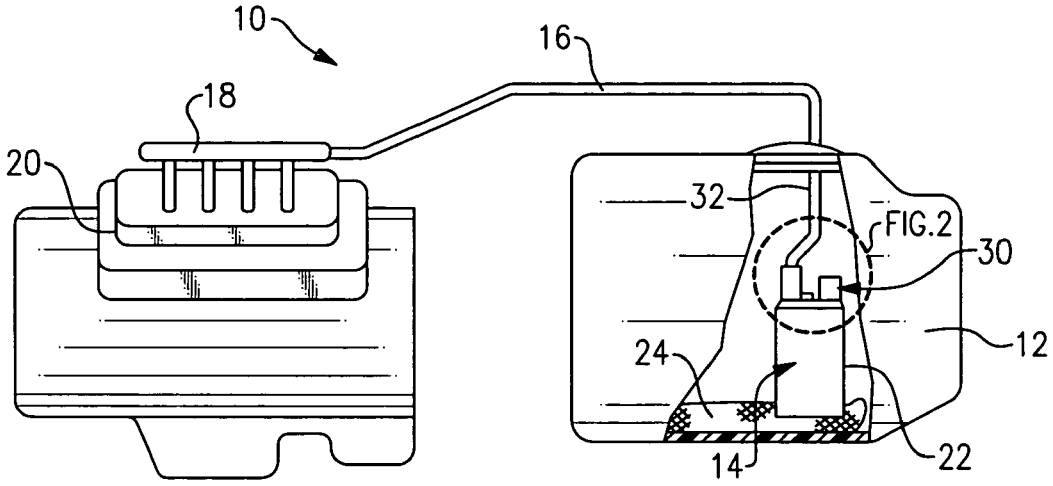
FIG. 1 is a partly fragmented, elevational view of an exemplary vehicle fuel delivery system in which the fuel relief valve of the present invention is useful.

The present invention provides a pressure relief valve useful in vehicle fuel delivery systems such as fuel delivery system 10 seen in FIG. 1. Vehicle fuel delivery system 10 includes a fuel tank 12 having a high pressure fuel pump 14 connected to a fuel line 16 which leads to a fuel rail 18 connected to individual fuel injectors leading into an engine 20. Fuel pump 14 is operable to deliver fuel under pressure from tank 12 through fuel line 16 to engine 20 as described above.

Figure 2:
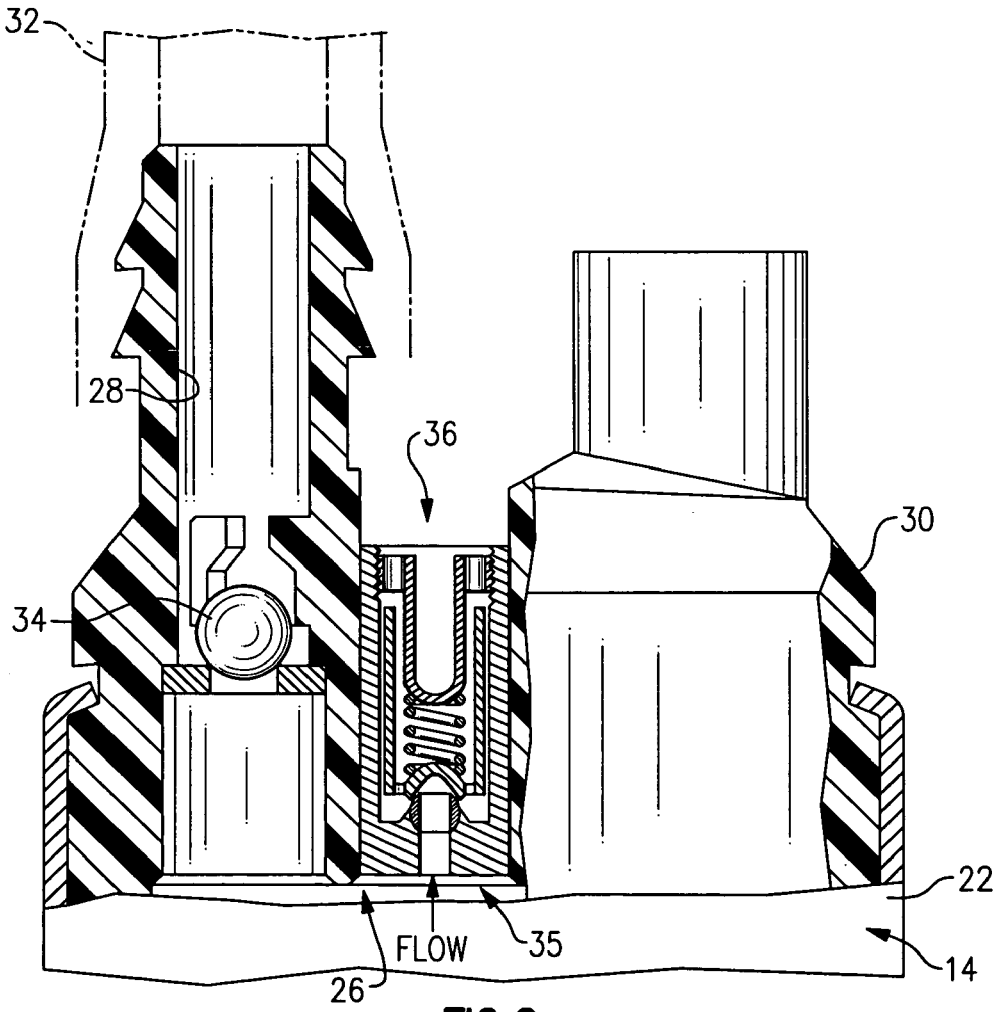
FIG. 2 is a cross-section of the part inside reference circle 2 in FIG. 1 which includes an embodiment of the pressure relief valve of the present invention.

Referring also to FIG. 2, a pump housing 22 of the fuel pump 14 surrounds a high pressure pump and an electric motor (not shown) for driving a rotating element of the high pressure pump. The high pressure pump is supplied with fuel from the fuel tank 12 through an inlet screen 24 and discharges fuel into an interior volume 26 of the housing 22 around the electric motor. From the interior volume 26 of the housing 22, the discharge of the high pressure pump flows to the fuel line 16 through a discharge passage 28 in an end housing 30 of the fuel pump 14 and a conduit 32 in the fuel tank. A check valve 34 in the discharge passage 28 prevents back flow from the fuel line 16 into the interior volume 26 of the housing 22.

When the electric motor of the fuel pump is on, the high pressure pump discharges fuel into the interior volume 26 of the housing 22 at a substantially constant flow rate which exceeds the maximum consumption rate of the engine 20. A pressure relief valve 36 according to this invention on the end housing 30 regulates a substantially constant pressure in the interior volume 26 of the housing 22 and in the fuel line 16 and fuel rail 18 by spilling directly back into the fuel tank 12 a varying fraction of the discharge of the positive displacement pump.

Referring to FIG. 2, valve 36 is placed in an opening 35 formed in end housing 30 and which communicates with interior volume 26 of the pump 14. Although not shown, the end housing 30 may include other elements of the fuel pump, e.g., a bearing for an armature shaft of the electric motor. Also, the valve body 38 of the pressure regulating valve 36 may be integrally formed with the end housing 30 if desired.

Figure 3A:
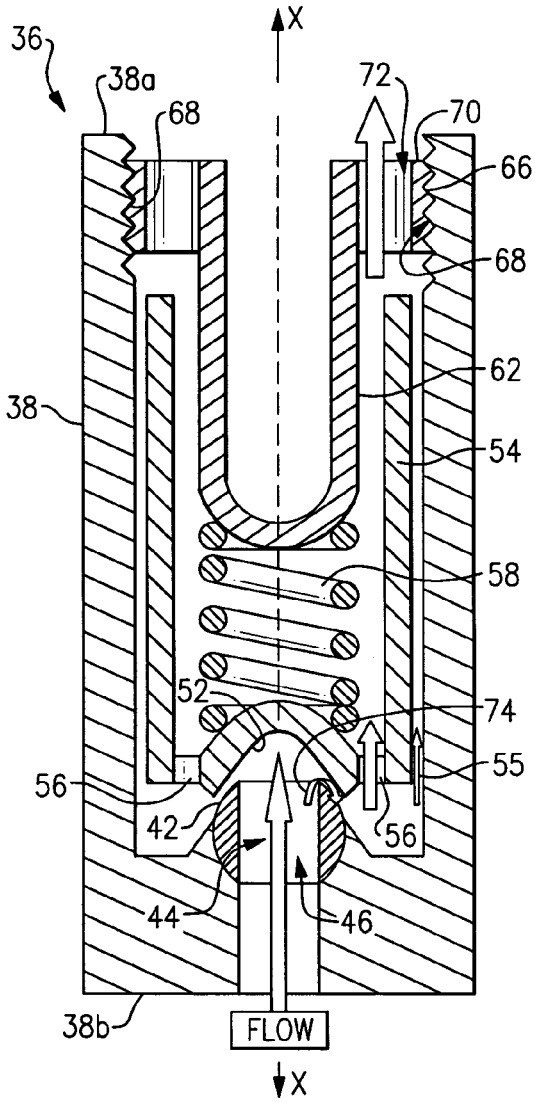
FIG. 3A is an enlarged view the embodiment of the flow relief valve of the present invention seen in FIG. 2 and showing the valve in the open position.
Figure 3B:
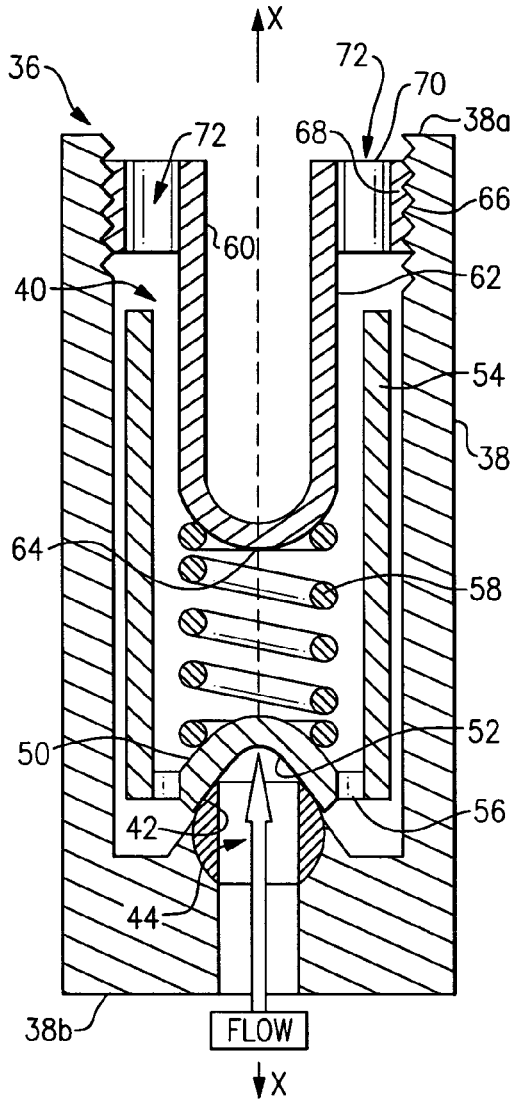
FIG. 3B is the view of FIG. 3A showing the valve in the closed position.

As seen best in FIGS. 3A and 3B, fuel relief valve 36 includes a valve body 38 having first and second opposite ends 38*a*, 38*b* and a bore comprising a flow channel 40 extending along a longitudinal axis x—x between first and second valve body ends 38*a* and 38*b*. A substantially spherical valve seat surface 42 is positioned in the valve body opening and includes a central opening 44 comprising a flow channel 46 in fluid communication with flow channel 40 of the valve body when said valve is in the open position seen in FIG. 3A.

Figure 4:
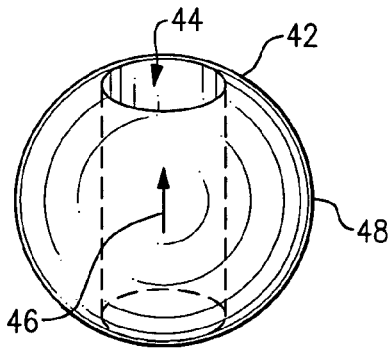
FIG. 4 is a perspective view of the ball element of the valve seen in FIGS. 2, 3A and 3B.

The spherical valve seat surface 42 may be part of the surface of a substantially spherical ball 48 with flow channel 46 extending entirely through ball 48 (see FIG. 4).

A valve element 50 having a concave conical surface 52 is positioned in valve body 38 adjacent spherical valve seat surface 42, valve element 50 being movable along longitudinal axis x—x of the first flow channel 40. A valve positioning element 54 may be fixed to valve element 50 to assist in maintaining the proper axial movement of valve element 50 in valve body 38. The valve positioning element 54 may be cylindrically shaped for telescoping, reciprocal movement along valve body axis x—x. One or more through holes 56 may be formed between valve element 50 and valve positioning element 54 to allow flow therethrough during the open condition of the valve 36 (FIG. 3A). The outer diameter of valve positioning element 54 may be less than the inner diameter of valve body 38 such the fluid may flow therebetween as indicated by arrow 55 in FIG. 3A.

A spring 58, which may be a coil spring, is positioned in valve flow channel 40 for biasing valve 36 in the closed position wherein valve element conical surface 52 sits against spherical surface 42 to create a fluid-tight seal therebetween (FIG. 3B). A spring anchoring element 60 is provided to position spring 58 along axis x—x with the desired amount of biasing force against valve element 50. Spring anchoring element 60 may include a finger portion 62 extending along axis x—x radially inwardly of valve element positioning element 54. Finger portion 62 may include a convex terminal end 64 for seating against spring end 58*a* throughout the axial tensioning and release movements of the spring in response to the axial movements of the valve element 50.

Spring anchoring element 60 is connected to valve body 38 and may be adjustable with respect thereto along axis x—x via mating threads 66, 68 formed on the inside surface of valve body 38 and along the outer surface of neck portion 70, respectively. One or more through holes 72 may be formed through neck portion 70 to allow fluid flow to exit valve body 38 whereupon the fluid is spilled back into tank 12.

Referring again to FIG. 3A, fluid may flow through flow channel 46 and reach valve element 50, causing valve element 50 to move away from spherical surface 42 and thereby opening valve 36 upon the fluid flow exceeding the biasing force of spring 54. As the valve opens, fluid flows from between spherical surface 42 and conical surface 52 initially in a reverse direction upstream of the flow source as indicated by arrow 74. Fluid may then flow through holes 56 and also between valve positioning element 54 and valve body 38 and lastly through holes 72 to exit the valve body and spill into tank 12.

The valve element 60 has a range of open positions, not shown, characterized by progressively more distant separation of the flow directing surface 52 from the valve seat 58 in which the flow directing surface and the valve seat cooperate in defining therebetween an annular flow orifice through which the passage 44 communicates with the bore 40. The (del. Maximum) spacing of the open position of the valve element from the valve seat may be between about 0.001 to 0.03 inches, for example.

When the electric motor of the fuel pump 14 is off, the spring 58 seats the flow directing surface 52 of the valve element 50 against the valve seat 42 to block fluid flow into the bore 40. The fuel rail 18 and high pressure conduit 16 are filled with fuel trapped by the check valve 34 (FIG. 2).

When the electric motor of the fuel pump 14 is on, the pressure regulating valve 36 regulates a substantially constant fluid pressure in the interior volume 26 of the housing 22, in the high pressure conduit 16 and in the fuel rail 18 by spilling fuel directly back into the fuel tank 12 a fraction of the substantially constant discharge of the high pressure pump of the fuel pump. The fraction spilled back into the fuel tank is inversely proportional to the fraction consumed by the engine 20.

More particularly, when the electric motor is turned on, rapidly increasing fluid pressure in the interior volume 26 reacts against the flow directing surface 52 of the valve element 50. When the net fluid pressure force on the valve element 50 exceeds the force exerted by the spring 58 on the valve element, the valve element moves along axis x—x to an open position. The flow spills through the annular flow orifice created between the now spaced valve element 50 and valve seat 42 from the interior volume 26. The flow may then continue through openings 55, 56 and 72 to ultimately spill back into the fuel tank 12.

Upstream of the annular flow orifice, the spill flow is redirected by the flow directing surface 52 through an angle greater than about 90 degrees and thereby induces on the valve element a corresponding force reaction attributable to the change in direction of the spill flow. The valve element 50 stabilizes in an open position within its range of open positions when static equilibrium is achieved between the force of spring 58 on the valve element 50 and the sum of the fluid pressure and directional change reactions on the valve element 50. In that circumstance, the rate of spill flow through the annular orifice maintains the fluid pressure in the interior volume 26 at a predetermined, regulated magnitude.

The valve element 50 maintains the regulated pressure in the interior volume 26 by increasing and decreasing the size of the annular flow orifice as the fraction of the discharge of the positive displacement pump consumed by the engine 20. When the fraction consumed by the engine decreases, instantaneous fluid pressure in the interior volume 26 increases and disturbs the aforesaid static equilibrium so that the valve element 50 translates along axis x—x to an open position having a larger corresponding annular flow orifice. Conversely, when the fraction consumed by the engine increases, instantaneous fluid pressure in the interior volume decreases and disturbs the aforesaid static equilibrium so that the valve elements translates linearly to an open position having a smaller corresponding annular flow orifice.

The aforesaid force reaction on the valve element 50 attributable to the change in direction of the spill flow improves the response of the valve element to changes in the engine-consumed fraction of the discharge of the high pressure pump. For example, when the engine-consumed fraction decreases and the instantaneous fluid pressure force reaction increases, axial translation of the valve element 50 increases the flow area of the annular orifice. Concurrently, the spill flow rate and corresponding direction change force reaction on the valve element 50 also increase, thereby contributing to more rapid translation of the valve element to the new open position.

Conversely, when the engine-consumed fraction of the discharge of the high pressure pump increases and the instantaneous fluid pressure force reaction decreases, axial translation of the valve element 50 decreases the flow area of the annular orifice. Concurrently, the spill flow rate and corresponding direction change force reaction on the valve element 50 also decrease, thereby contributing to more rapid translation of the valve element to the new open position by the spring 58.

The valve element 50 is further exposed to a pressure gradient attributable to the velocity of the spill flow immediately downstream of the annular orifice between the valve seat 42 and the flow directing surface 52. Such flow velocity induces a zone of low pressure relative to the pressure in the area of the valve body 38 surrounding the valve element which biases the valve element toward the low pressure side of the gradient. If such pressure gradient has a substantial component parallel to the direction of axial translation of the valve element 50, the sensitivity of the valve element to changes in the fuel consumption rate of the engine 20 may be compromised.

The valve positioning element 54 also functions to direct spill flow substantially parallel to the direction of axial translation of the valve element, i.e., substantially parallel to longitudinal axis x—x, so that the flow velocity induced pressure gradient is perpendicular to the axis x—x and without any substantial component parallel to the direction of axial translation of the valve element 50. Further, since the flow velocity induced pressure gradient acts around the full circumference of the valve seat 42, the forces attributable to that gradient are all directed through the axis x—x and do not tilt the valve element 50 off-axis.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A pressure relief valve comprising:

a) a valve body having first and second opposite ends and a bore defining a flow channel extending along a longitudinal axis between said first and second ends;

b) a substantially spherical valve seat positioned in said valve body bore, said seat having a central opening in fluid communication with said valve body flow channel when said valve is in the open position;

c) a valve element having a concave conical surface and positioned in said valve body adjacent said valve seat, said valve element movable along said longitudinal axis of said valve body flow channel; and d) a spring positioned in said valve body flow channel for biasing said valve in the closed position wherein said valve element conical surface sits against said spherical seat surface to create a fluid-tight seal therebetween, whereby a fluid may flow through said central opening and reach said valve element, said valve element moving away from said seat and opening said valve upon the fluid flow exceeding the biasing force of said spring.

2. The valve of claim 1, wherein said valve element is fixed to a valve positioning element movable along said longitudinal axis of said valve body flow channel.

3. The valve of claim 2 wherein said valve positioning element is substantially cylindrically shaped and smaller in diameter than said valve body such that fluid may flow therebetween.

4. The valve of claim 3 and further comprising one or more holes formed between said valve element and said valve positioning element wherethrough fluid may flow.

5. The valve of claim 1 and further comprising a spring anchoring element fixed to said valve body adjacent said first end thereof.

6. The valve of claim 5 wherein said spring anchoring element has a smaller diameter than said valve body such that fluid may flow therebetween.

7. The valve of claim 6 wherein said spring anchoring element is attached to said valve body in axially adjustable relation thereto.

8. The valve of claim 7 wherein one or more holes are formed through said spring anchoring element to allow fluid to flow therethrough and exit said valve body.

9. The valve of claim 8 wherein said holes are formed in a neck portion having threads for engaging mating threads on said valve body which provide said adjustability of said spring anchoring element.

10. The valve of claim 5 wherein said spring is a coil spring and said spring anchoring element includes a finger shaped portion having a convex terminal end for seating against said spring.

11. The valve of claim 1 wherein said spherical surface is part of a spherical ball.

12. A method for providing pressure relief in a fuel pump housing of a vehicle fuel delivery system in response to fuel consumption by an engine of the vehicle, said method comprising the steps of:

a) providing a valve body having first and second opposite ends and a bore defining a flow channel extending along a longitudinal axis between said first and second ends;

b) providing a substantially spherical valve seat positioned in said valve body bore, said seat having a central opening in fluid communication with said valve body flow channel when said valve is in the open position;

c) providing a valve element having a concave conical surface and positioned in said valve body adjacent said valve seat, said valve element movable along said longitudinal axis of said valve body flow channel; and d) providing a spring positioned in said valve body flow channel for biasing said valve in the closed position wherein said valve element conical surface sits against said spherical seat surface to create a fluid-tight seal therebetween, whereby fluid may flow through said central opening and reach said valve element, said valve element moving away from said seat and opening said valve upon the fluid flow exceeding the biasing force of said spring, the opening of said valve thereby providing pressure relief.

13. The method of claim 12, wherein said valve element is fixed to a valve positioning element movable along said longitudinal axis of said valve body flow channel.

14. The method of claim 13 wherein said valve positioning element is substantially cylindrically shaped and smaller in diameter than said valve body such that fluid may flow therebetween.

15. The method of claim 14 and further comprising one or more holes formed between said valve element and said valve positioning element wherethrough fluid may flow.

16. The method of claim 12 and further comprising the step of providing a spring anchoring element fixed to said valve body adjacent said first end thereof.

17. The method of claim 16 wherein said spring anchoring element has a smaller diameter than said valve body such that fluid may flow therebetween.

18. The method of claim 17 wherein said spring anchoring element is attached to said valve body in axially adjustable relation thereto.

19. The method of claim 18 wherein one or more holes are formed through said spring anchoring element to allow fluid to flow therethrough and exit said valve body.

20. The method of claim 19 wherein said holes are formed in a neck portion having threads for engaging mating threads on said valve body which provide said adjustability of said spring anchoring element.

21. The method of claim 20 wherein said spring is a coil spring and said spring anchoring element includes a finger shaped portion having a convex terminal end for seating against said spring.

22. The method of claim 21 wherein said spherical surface is part of a spherical ball.

* * * * *